US007240372B2

(12) United States Patent
Larson

(10) Patent No.: US 7,240,372 B2
(45) Date of Patent: Jul. 10, 2007

(54) MULTI-PURPOSE HAT

(76) Inventor: Van Larson, 513 S. Sixth St., Grand Forks, ND (US) 58201

( * ) Notice: Subject to any disclaimer, the term of this patent is extended or adjusted under 35 U.S.C. 154(b) by 301 days.

(21) Appl. No.: 10/923,503

(22) Filed: Aug. 20, 2004

(65) Prior Publication Data

US 2005/0066417 A1 Mar. 31, 2005

Related U.S. Application Data

(60) Provisional application No. 60/497,165, filed on Aug. 22, 2003.

(51) Int. Cl.
*A42B 1/18* (2006.01)

(52) U.S. Cl. ..... 2/173

(58) Field of Classification Search ..... 2/173, 2/206, 207, 900, 909, 918, 183
See application file for complete search history.

(56) References Cited

U.S. PATENT DOCUMENTS

| | | | | | |
|---|---|---|---|---|---|
| 766,963 | A | * | 8/1904 | Murray | 2/206 |
| 0,798,877 | A | | 9/1905 | Conne | |
| 2,078,511 | A | * | 4/1937 | Riebold | 2/183 |
| 2,295,826 | A | | 9/1942 | Brav | |
| 2,462,258 | A | | 2/1949 | Dannenberg | |
| 2,472,033 | A | | 5/1949 | Wetzel | |
| 2,839,757 | A | | 6/1958 | Gianola | |
| 2,897,510 | A | | 8/1959 | Forbes-Robinson | |
| 4,180,868 | A | * | 1/1980 | Snow | 2/918 |
| 4,593,417 | A | | 6/1986 | Brown, Jr. et al. | |
| D296,031 | S | | 6/1988 | Coy et al. | |
| 4,980,928 | A | | 1/1991 | Ellis | |
| 5,062,163 | A | * | 11/1991 | Avey | 2/424 |
| 5,091,996 | A | * | 3/1992 | Kirby | 2/206 |
| 5,212,837 | A | * | 5/1993 | Gose et al. | 2/172 |
| 5,214,804 | A | | 6/1993 | Carey et al. | |
| 5,251,336 | A | | 10/1993 | Nevins | |
| 5,459,881 | A | | 10/1995 | Fagan et al. | |
| D367,549 | S | | 2/1996 | Deziel | |
| 5,551,087 | A | | 9/1996 | Blutstein et al. | |
| 5,575,009 | A | | 11/1996 | Ryvin | |
| 5,623,732 | A | | 4/1997 | Olajide, Jr. | |
| 5,649,327 | A | | 7/1997 | Crewe | |
| 5,694,648 | A | * | 12/1997 | Nucifora | 2/172 |
| 5,713,077 | A | * | 2/1998 | Humbrecht | 2/173 |
| 5,822,800 | A | | 10/1998 | Anderson | |
| 5,839,432 | A | | 11/1998 | Daneshvar | |
| 5,845,340 | A | * | 12/1998 | Frislie | 2/202 |

(Continued)

FOREIGN PATENT DOCUMENTS

WO WO 03/037122 A1 5/2003

*Primary Examiner*—Gary L. Welch
(74) *Attorney, Agent, or Firm*—Robert D. Atkins; Quarles & Brady LLP

(57) ABSTRACT

A multi-purpose head covering is disclosed. The multi-purpose head covering includes a hat capable of covering at least a portion of a wearer's head and a mask capable of covering at least a portion of a wearer's face. The mask has a central body and two extensions on either side of the central body. Each of the two extensions comprises a mask attachment member for attachment to the hat. The mask also includes a number of releasable fasteners, such as snaps, such that when the releasable fasteners are engaged to one another, the size of the mask changes.

26 Claims, 4 Drawing Sheets

U.S. PATENT DOCUMENTS 5,924,129 A * 7/1999 Gill ..... 2/206
5,933,871 A * 8/1999 Kraft ..... 2/209.13
6,467,096 B1 * 10/2002 Coluccio ..... 2/195.2
6,499,141 B1 * 12/2002 Egnew ..... 2/900
6,996,852 B1 * 2/2006 Cabrera ..... 2/172

* cited by examiner

MULTI-PURPOSE HAT

RELATED APPICATION

The present application claims the benefit of U.S. Provisional Application No. 60/497,165 filed Aug. 22, 2003, which is incorporated herein in its entirety by reference.

FIELD OF THE INVENTION

The present invention relates generally to the field of hats and headgear. More specifically, the present invention relates to a multi-purpose hat including an ability to adapt to either changing weather conditions or a change in use by a wearer.

BACKGROUND OF THE INVENTION

Hats in a variety of forms are worn by people around the world every day. Hats having wide brims are commonly worn to limit sun exposure to the head and neck or to shield a person's eyes from the sun. Often times, hats are used as fashion accessories to complete an outfit. In other situation, hats are worn as part of a uniform such as by a police officer or by a baseball player.

One common reason that individuals wear hats is to promote comfort and limit their exposure to certain weather conditions. Hats are often worn during the fall, winter and spring to protect the wearer from weather conditions such as frigid temperature, snow, rain and wind that may make the wearer uncomfortable or even result in the wearer being exposed to dangerous conditions.

Due to these concerns, a number of hat designs incorporating face protection means, such as a mask have been suggested. Examples of such designs include U.S. Pat. No. 2,798,877 Conne; U.S. Pat. No. 2,462,258 Dannenberg; U.S. Pat. No. 2,839,757 Gianola; U.S. Pat. No. 2,897,510 Forbes-Robinson; U.S. Pat. No. 4,180,868 Snow; U.S. Pat. No. 4,593,417 Brown, Jr. et al.; U.S. Pat. No. 5,214,804 Carey et al.; U.S. Pat. No. 5,251,336 Nevins; U.S. Pat. No. 5,551,087 Blutstein et al.; U.S. Pat. No. 5,575,009 Ryvin; U.S. Pat. No. 5,694,648 Nucifora; U.S. Pat. No. 5,822,800 Anderson; U.S. Pat. No. 5,839,432 Daneshvar; U.S. Pat. No. 6,260,204 Morrissey; U.S. Pat. No. 6,260,206 MacDonald et al.; and U.S. Pat. No. D296,031 Coy et al.; all of which are hereby incorporated by reference in their entirety.

U.S. Pat. No. 5,694,648 Nucifora describes a hat with protective coverings for the neck, ears and face. The coverings are removable and can be stored in the hat. A face mask that covers the eyes, nose and mouth of the wearer is also included, where eye ports are cut into the mask.

U.S. Pat. No. 798,877 Conne discloses a hat with a visor. The visor is hinged to the body portion of the hat and can be swung down into position to be used as a face protector. In addition, the visor can be removed from the hat.

U.S. Pat. No. 4,593,417 Brown, Jr. et al. describes a mask and hat combination, where the mask portions can be folded out of the way. The folded mask portions can be folded upward and affixed to the crown of the hat.

Hats that include a mask-type facial covering are known in the art. However, face masks that can be attached to a hat may be difficult to attach and reattach. In addition, the face mask may allow for cold air, dust and other unwanted particles to enter the facial area, due to the mask not being fitted to the wearer's face or adjustable to the wearer's face. Hence, there is a need for facial mask that can be easily attached and detached from a hat, and a mask whose size can be adjusted by the wearer.

Another frequent use of hats is by hunters or other outdoor enthusiasts. Often times, there may be a law or a hunting standard requiring participants to wear hats and other clothing having bright, distinctive colors to promote visibility. Even non-hunters will frequently wear such headgear when in the outdoors during open hunting seasons to clearly distinguish themselves to hunters who may be in the vicinity. In other situations, hunters may wear a hat designed to blend in with the surrounding environment and limit the possibility of being seen by the hunter's prey as suggested by U.S. Pat. No. 6,499,141 to Egnew, which is hereby incorporated by reference in its entirety.

As much of the hunting is done in the early spring or late fall, hunters are often exposed to a wide variety of weather conditions during the day. As a hunter's day often begins before sunrise and may extend beyond sunset, hunters often experience freezing temperatures early in the morning or in the early evening. Oftentimes, the same hunters will experience temperatures 20 to 30 degrees higher during the late morning and early afternoon of the same day. With these changing temperature conditions, hunter's can also experience a combination of rain and snow on any given day.

In addition to the changing weather conditions, hunters may utilize their hats for a number of uses during a single day. Early in the morning hats are often worn to limit exposure to cold weather, to signify their presence to other hunters, or to blend into their surroundings. Later in the day, hats may be used to limit exposure to the sun.

U.S. Pat. No. 6,260,206 MacDonald et al. describes a modular hat that can take on a number of shapes, with various attachment pieces. The hat configuration can be matched to the environmental conditions the wearer is experiencing.

Because of the multiplicity of uses a hunter may have for his or her hat on any given day, it would be desirable to have a hat that can adapt to accommodate the hunter's current situation.

SUMMARY OF THE INVENTION

The multi-purpose hat of the present invention provide a user, typically a hunter or other outdoor enthusiast, with multiple wearing options depending on the variety of situations they face each day in the field. More specifically, the hat includes a traditional hat portion and a removable mask portion adapted to comfortably conform to the users head and face.

The hat portion can comprise a number of different styles and appearances. It is envisioned that the hat can take the form of a traditional ball cap, watch cap, stocking cap or the hat can include a wide brim around the entire perimeter of the hat. The hat portion can include bright, highly visible colors such as blaze orange or red or it may comprise camouflaged materials selected to blend into a selected outdoor background. The hat portion may include sizing means allowing the hat portion to accommodate a wide variety of head sizes or comfort levels. The hat portion may also include storage means allowing a user to store necessary items such as hunting licenses, money, keys or other similar items.

The removable mask portion is also envisioned to encompass a variety of configurations. The mask portion may include fabrics selected for breathability or for certain insulating characteristics. The mask portion may be comprised of camouflaged materials making a users face almost invisible when placed in certain backgrounds. The mask portion can include attachment means such as hook and loop fasteners, button, snaps, zippers or other suitable attaching means to facilitate attachment to and removal from the hat portion. The mask portion may include certain features promoting sealing around the face or chin, such as elastic or snaps, for a comfortable fit.

In one aspect, the multi-purpose hat of the present invention is used to provide comfort to a wearer and eliminate exposure to certain weather conditions, such as cold temperatures, rain, wind, or snow.

In another aspect, the multi-purpose hat of the present invention is used to provide nearby hunters and outdoors enthusiasts with a visible indicator of the hunters presence in the area.

In another aspect, the multi-purpose hat of the present invention is used to reduce the visibility of a wearer to nearby prey.

In another aspect, the multi-purpose hat of the present invention is adapted to accommodate the changes a hunter or outdoor enthusiast may experience with regard to changing weather conditions and types of activity.

DETAILED DESCRIPTION OF THE PREFERRED EMBODIMENTS

Figure 1:
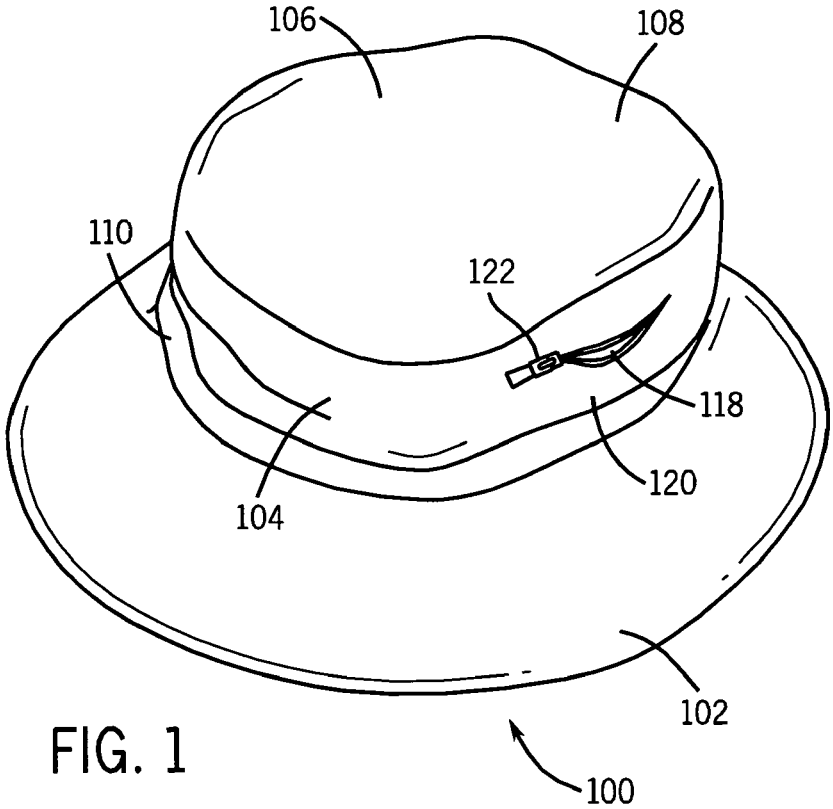
FIG. 1 is a front, perspective view of an embodiment of a hat portion.
Figure 2:
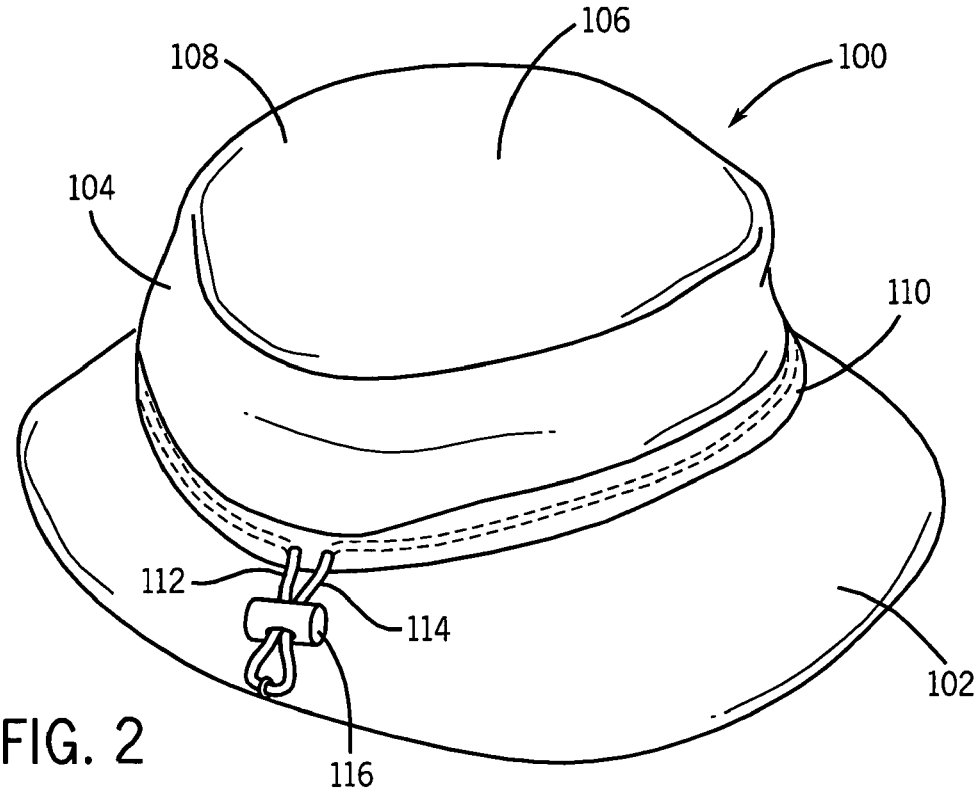
FIG. 2 is a rear, perspective view of the hat portion of FIG. 1.

As illustrated in FIGS. 1 and 2, a hat portion 100 includes a perimeter brim 102, a side wall 104 and a top surface 106. Generally, hat portion 100 is manufactured using a fabric 108 or material that is both comfortable when worn and suitable for outdoor use. Examples of suitable materials could include wool, polyester, polar fleece, cotton, gore-tex, nylon or other suitable materials. In addition, these materials may include certain other desirable characteristics for outdoor use such as waterproofing, wind and/or water resistance, insulation and breathability.

Fabric 108 can comprise a variety of different colors and/or appearances based on the intended use. For example, fabric 108 can include bright, highly visible colors such as blaze orange or red to impart high visibility in the field. Fabric 108 could alternatively include colors and shapes creating a camouflaged appearance selectively chose to blend into certain outdoor environments to reduce the potential for a user, such as a hunter, being seen by their prey.

Hat portion 100 can include a band 110 positioned to cover at least a portion of a sizing means 112. As depicted, sizing means 112 comprises an elastic cord 114 and a releasable locking mechanism 116. Elastic cord 118 can be sized to wrap partially or fully around side wall 106.

Hat portion 100 can also include one or more storage means 118 located in either the perimeter brim 102, side wall 104 or top surface 106. As depicted, storage means 118 includes a pocket 120 within fabric 108 and a zipper 122. Alternatively, zipper 122 could be replaced with a hook and loop fastener, a snap, a button or any other suitable fastening means.

Figure 3:
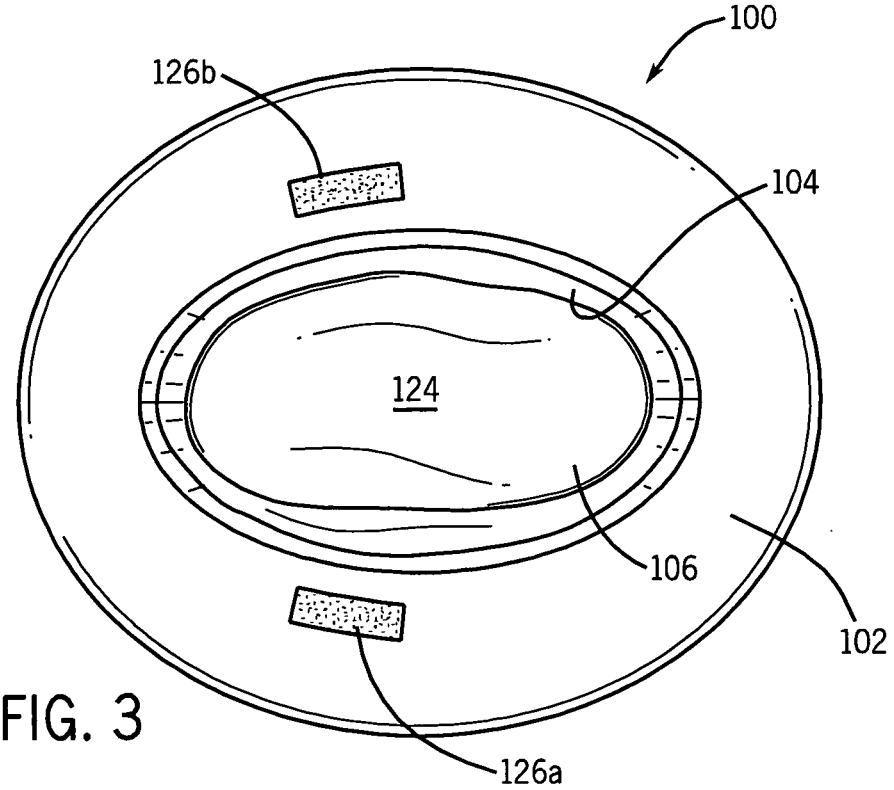
FIG. 3 is a bottom view of the hat portion of FIG. 1.

Hat portion 100 is further depicted in FIG. 3. As depicted, hat portion 100 includes an internal volume 124 defined by side wall 104 and top surface 106 that is adapted for placement over a user's head. Though not depicted, hat portion 100 could comprise an insulating liner adapted to fit within internal volume 124 to provide additional warmth and comfort to a wearer during exposure to cold weather. On the bottom side of brim 102 is a pair of opposed hat attachment members 126*a*, 126*b*.

Hat attachment members 126*a*, 126*b* can take the form of hook and loop fastener strips as shown or could include snaps, buttons, zippers or other suitable attaching means. Hat attachment members are preferably sufficiently large to allow mask portion 130 to be attached in a variety of different configurations depending on the size of the person that is wearing the hat 100.

Figure 4:
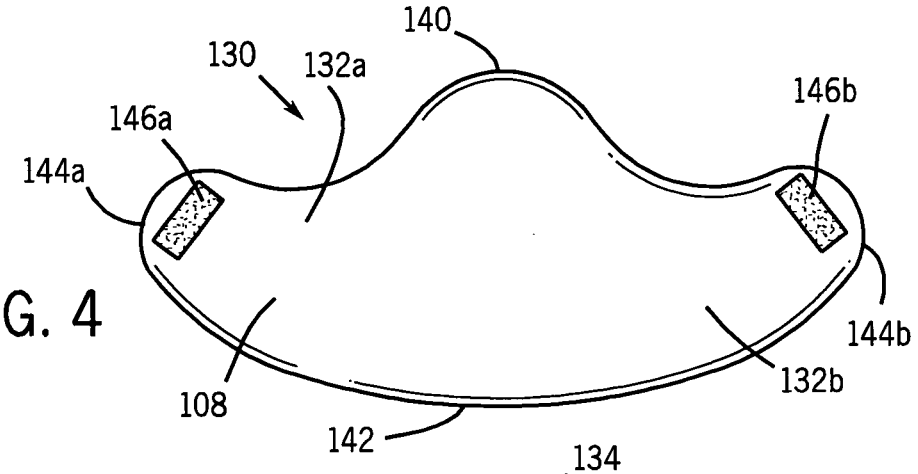
FIG. 4 is a front, perspective view of a mask portion.
Figure 5:
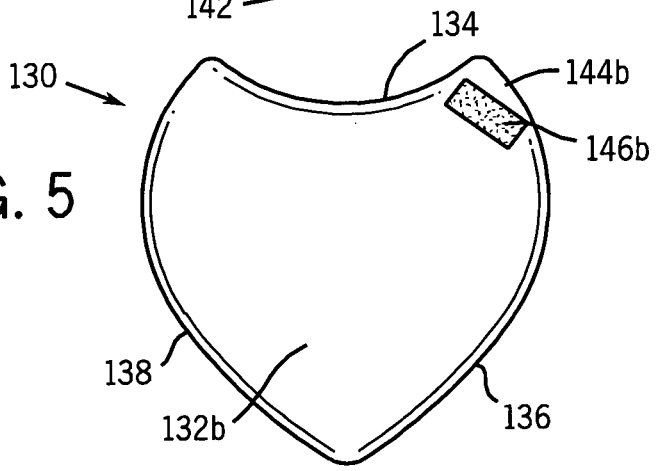
FIG. 5 is a side view of the mask portion of FIG. 4.

Depicted in FIGS. 4 and 5 is a mask portion 130. Mask portion 130 may be comprised of fabric 108 or may comprise other materials that offer features beneficial to the masking function. Generally, mask portion 130 comprises a pair of mirror imaged masking sections 132*a*, 132*b*. As shown in FIG. 5, masking section 132*b* includes a concave upper surface 134, a convex lower surface 136 and a convex intermediate surface 138.

Masking sections 132*a*, 132*b* are joined together at their intermediate surfaces 138, typically by stitching to form mask portion 130. As such, mask portion 130 comprises an upper surface 140 and a lower surface 142. Upper surface 140 and lower surface 142 may include elastic portions providing beneficial fit characteristics. Mask portion 130 further comprises a pair of ends 144*a*, 144*b*, each end including a mask attaching member 146*a*, 146*b* selected for an ability to connect to hat attachment members 126*a*, 126*b*.

Figure 6:
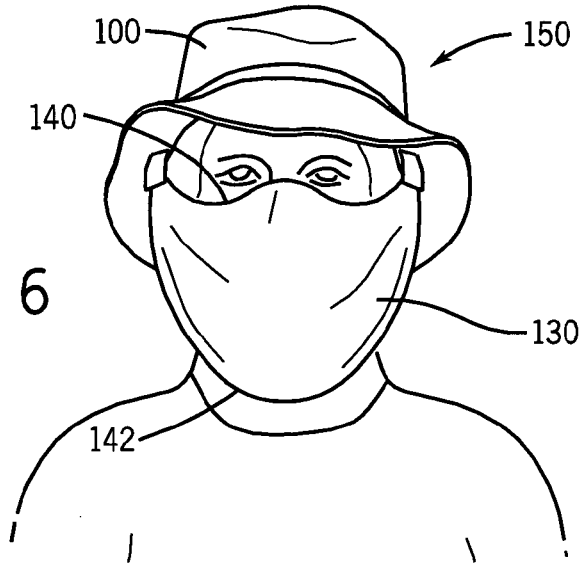
FIG. 6 is a front view of an embodiment of a multi-purpose hat of the present invention being worn by a user.
Figure 7:
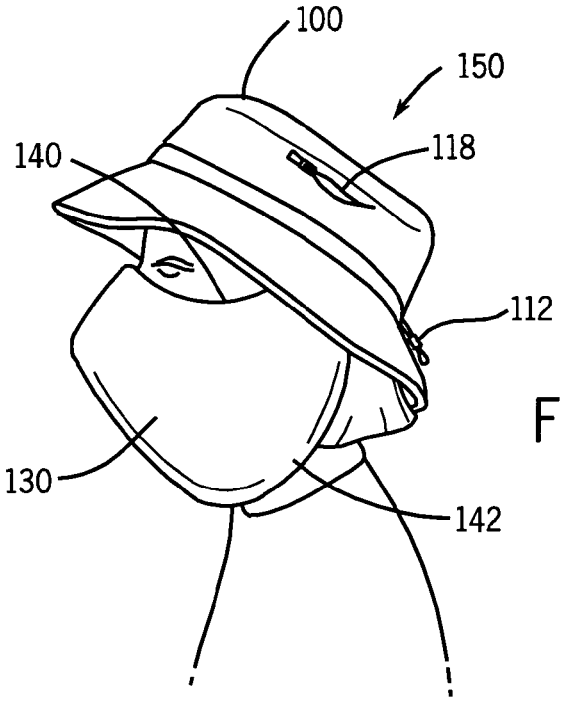
FIG. 7 is a side view of the multi-purpose hat of FIG. 6 being worn by a user.

In combination, hat portion 100 and mask portion 130 are used to form multi-purpose hat 150 as shown in FIGS. 6 and 7. Generally, hat portion 100 is worn such that internal volume 124 cover's the top of a user's head. Depending upon the size of the user's head or to create a desired fit, the user can use sizing means 112 to increase or decrease the effective diameter of the side wall 104 simply by opening the locking member 116 and adjusting the elastic cord 114.

Once the hat portion 100 is positioned, mask portion 130 is attached to hat portion 100 by attaching hat attachment members 126*a*, 126*b* to mask attaching members 146*a*, 146*b*. When attached, mask portion 130 serves to protect the face of the user from exposure to the environmental conditions or to camouflage the face from view by potential prey.

The concave upper surface 134 of masking sections 132*a*, 132*b* adapt upper surface 140 to fit over the nose of the user without covering the eyes of the user. At the same time, lower surface 142 pulls below the chin and creates a barrier along the neck of the wearer. If upper surface 140 or lower surface 142 includes elastic, the mask portion 130 can be stretched tight against the contours of the users face, neck and chin to provide an even tighter fit and a better seal from the environment.

Figure 10:
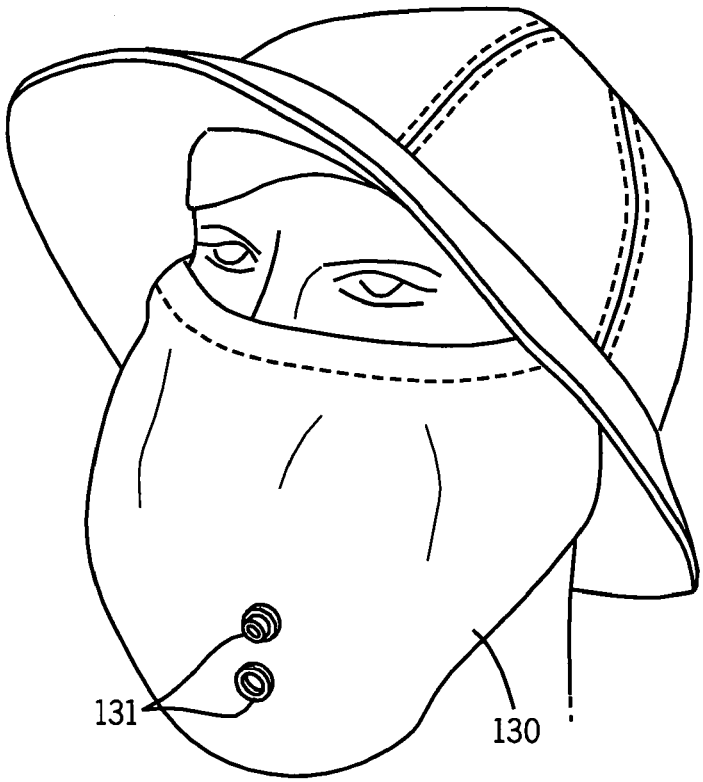
FIG. 10 is a perspective view of another embodiment of the multi-purpose hat.

Additionally, lower surface 142 can include a number of snaps 131 or other closure devices such as hook and loop fasteners, arranged with respect to a vertical line bisecting the mask into approximately two identical sides as illustrated in FIG. 10. Releasably engaging a closure on one side of the mask to a matching closure on the other side of the mask changes the size of the mask. Some or all of the closures can be engaged at any given time, dependent upon the needs of the wearer. The use of the closures can also provide for a tighter fit of the mask on the wearer's face.

Figure 8:
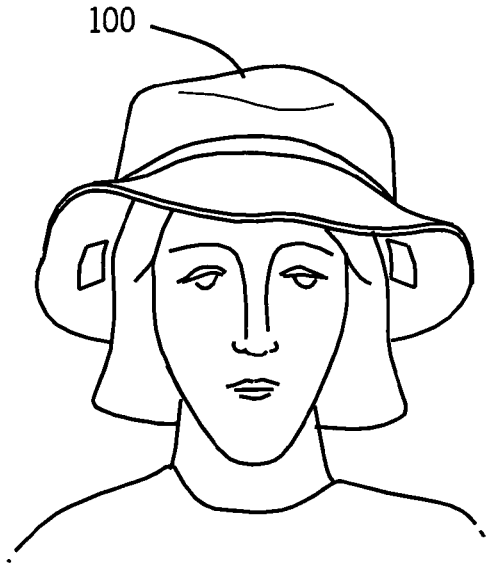
FIG. 8 is a front view of the hat portion of FIG. 1 being worn by a user.

If the user experiences a change in the weather, such as an increase in temperature, or no longer requires a camouflaged effect, such as following a successful hunt, or merely desires an increase in comfort, the user detaches hat attachment members 126*a*, 126*b* and mask attaching members 146*a*, 146*b* such that mask portion 130 is removed. The user can then continue to wear hat portion 100, as shown in FIG. 8, to provide protection from the sun or weather conditions. Through the use of hat attachment members 126*a*, 126*b* and mask attaching members 146*a*, 146*b*, mask portion 130 can be quickly attached or removed by a user in almost any environment, such as low-light situations or even when a user is wearing gloves that might tend to reduce a person's dexterity.

Figure 9:
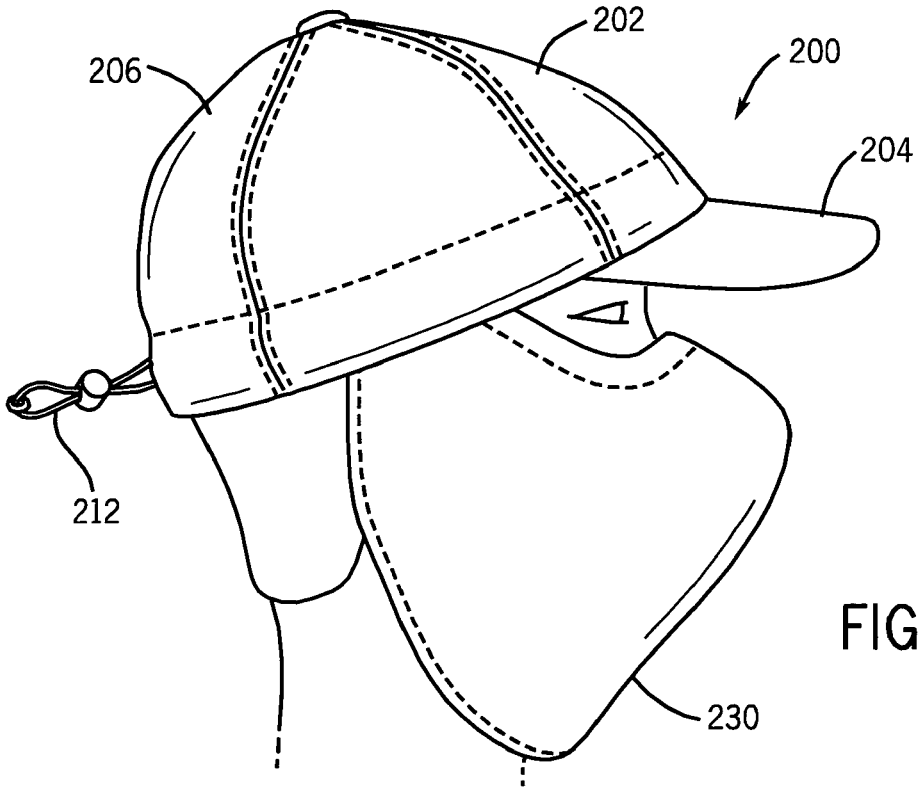
FIG. 9 is a side view of another embodiment of the multi-purpose hat being worn by a user.

It will be readily apparent that hat portion 100 can take multiple forms without departing from the spirit and scope of the present invention. For example, an embodiment of a multi-purpose hat 200 is depicted in FIG. 9 in which a hat portion 202 takes the form of a traditional baseball cap including a front brim 204 and a bowl shaped body 206. As made clear in the drawings, hat portion 202 comprises many of the features of the previously described hat portion 100 allowing attachment of mask portion 230 to form multi-purpose hat 200, such as sizing means 212.

Although various embodiments of the present invention have been disclosed here for purposes of illustration, it should be understood that a variety of changes, modifications and substitutions may be incorporated without departing from either the spirit or scope of the present invention.

What is claimed is:

1. A multi-purpose head covering for a user, comprising:

a hat having a first attachment member disposed on the hat; and a detachable mask having a concave upper portion extending up to an uppermost point to cover the nose of the user and extending down on either side of the uppermost point below the eyes of the user, and convex lower portion extending below the chin to cover a front portion of the neck of the user, and convex intermediate portions extending beyond the jaw on both sides of the face of the user for covering side portions of the neck of the user, the detachable mask having a fastener for securing a fold in the material to change the surface area of the mask covering the face of the user, the detachable mask further having a second attachment member for mating to the first attachment member to allow interchange of the detachable mask on the hat.

2. The multi-purpose head covering of claim 1, wherein the detachable mask provides insulation from outside elements.

3. The multi-purpose head covering of claim 1, wherein the detachable mask is colored to provide camouflage.

4. The multi-purpose head covering of claim 1, wherein the detachable mask is colored to provide visibility.

5. The multi-purpose head covering of claim 1, wherein the hat includes an adjustment for changing sizing of the hat.

6. The multi-purpose head covering of claim 1, wherein the hat includes a pocket for storage.

7. The multi-purpose head covering of claim 1, wherein the first and second attachment members are selected from the group consisting of snaps, buttons, zippers, and hook and loop fasteners.

8. A multi-purpose head covering for a user, comprising:

a hat;

a plurality of detachable masks, at least one of the plurality of detachable masks having a concave upper portion extending up to an uppermost point to cover the nose of the user and extending down on either side of the uppermost point below the eyes of the user, and convex lower portion extending below the chin to cover a front portion of the neck of the user, and convex intermediate portions extending beyond the jaw on both sides of the face of the user for covering side portions of the neck of the user, the at least one of the plurality of detachable masks further having a fastener for securing a fold in the material to change the surface area of the mask covering the face of the user; and attachment means for mating the hat to one of the plurality of detachable masks.

9. The multi-purpose head covering of claim 8, wherein one of the plurality of detachable masks has an elastic upper portion and an elastic lower portion.

10. The multi-purpose head covering of claim 8, wherein one of the plurality of detachable masks provides insulation from outside elements.

11. The multi-purpose head covering of claim 8, wherein one of the plurality of detachable masks is colored to provide camouflage.

12. The multi-purpose head covering of claim 8, wherein the detachable mask is colored to provide visibility.

13. The multi-purpose head covering of claim 8, wherein the hat includes an adjustment for changing sizing of the hat.

14. The multi-purpose head covering of claim 8, wherein the hat includes a pocket for storage.

15. The multi-purpose head covering of claim 8, wherein the attachment means is selected from the group consisting of snaps, buttons, zippers, and hook and loop fasteners.

16. A multi-purpose head covering for a user, comprising:

a hat;

a detachable mask for covering a face, the detachable mask having a concave upper portion extending up to an uppermost point to cover the nose of the user and extending down on either side of the uppermost point below the eyes of the user, and convex lower portion extending below the chin to cover a front portion of the neck of the user, and convex intermediate portions extending beyond the jaw on both sides of the face of the user for covering side portions of the neck of the user and a fastener for securing a fold in the material to change the surface area of the mask covering the face of the user; and an attachment mechanism for mating the detachable mask to the hat.

17. The multi-purpose head covering of claim 16, wherein the detachable mask is colored to provide camouflage.

18. The multi-purpose head covering of claim 16, wherein the detachable mask is colored to provide visibility.

19. The multi-purpose head covering of claim 16, wherein the hat includes an adjustment for changing sizing of the hat.

20. The multi-purpose head covering of claim 16, wherein the attachment mechanism is selected from the group consisting of snaps, buttons, zippers, and hook and loop fasteners.

21. A method of making a multi-purpose head covering, comprising:

providing a hat having a first attachment member disposed on the hat; and providing a detachable mask for covering a face, the detachable mask having a concave upper portion extending up to an uppermost point to cover the nose of the user and extending down on either side of the uppermost point below the eyes of the user, and convex lower portion extending below the chin to cover a front portion of the neck of the user, and convex intermediate portions extending beyond the jaw on both sides of the face of the user for covering side portions of the neck of the user, the detachable mask having a second attachment member for mating to the hat attachment member to make the detachable mask interchangeable on the hat.

22. The method of claim 21, further including disposing a fastener for securing a fold in the material to change the surface area of the mask covering the face of the user.

23. The method of claim 21, further including making the detachable mask of insulating material.

24. The method of claim 21, further including making the detachable mask a camouflage color.

25. The method of claim 21, further including making the detachable mask a visible color.

26. The method of claim 21, further including providing a pocket in the hat for storage.

* * * * *

UNITED STATES PATENT AND TRADEMARK OFFICE

CERTIFICATE OF CORRECTION

PATENT NO. : 7,240,372 B2
APPLICATION NO. : 10/923503
DATED : July 10, 2007
INVENTOR(S) : Van Larson and Jon Larson It is certified that error appears in the above-identified patent and that said Letters Patent is hereby corrected as shown below:

Title page item [76] add second inventor information as follows:

-- Jon Larson, 1401 Dyke Avenue, Grand Forks, ND (US) 58208 --

Signed and Sealed this

Twenty-first Day of August, 2007

JON W. DUDAS
*Director of the United States Patent and Trademark Office*